US011530842B1

(12) United States Patent
Schneider

(10) Patent No.: US 11,530,842 B1
(45) Date of Patent: Dec. 20, 2022

(54) BUCKET HEATER ASSEMBLY

(71) Applicant: Mark Schneider, Saint Cloud, MN (US)

(72) Inventor: Mark Schneider, Saint Cloud, MN (US)

( * ) Notice: Subject to any disclaimer, the term of this patent is extended or adjusted under 35 U.S.C. 154(b) by 0 days.

(21) Appl. No.: 17/476,199

(22) Filed: Sep. 15, 2021

(51) Int. Cl.
*F24H 3/00* (2022.01)
*F24H 9/06* (2006.01)

(52) U.S. Cl.
CPC ..... *F24H 3/00* (2013.01); *F24H 9/06* (2013.01)

(58) Field of Classification Search
CPC .. A47C 7/72; A47C 7/748; A47C 7/00; F24H 3/00; F24H 9/06
See application file for complete search history.

(56) References Cited

U.S. PATENT DOCUMENTS 2,567,323 A 9/1951 Cyphert
2,904,031 A 9/1959 Scott
4,475,532 A 10/1984 Woods
4,676,223 A * 6/1987 Peterson ..... A47C 7/748 126/204
4,913,126 A 4/1990 McCall
2015/0076202 A1* 3/2015 Jensen ..... A45F 3/04 224/645
2016/0021861 A1* 1/2016 Pippins ..... A01K 99/00 43/17.5

* cited by examiner

*Primary Examiner* — Steven S Anderson, II

(57) ABSTRACT

A bucket heater assembly for keeping a user warm in a remote location includes a bucket that has a vent hole extending through the bucket. A chimney is integrated into the bucket and the chimney extends through the vent hole. A heat source can be positioned in the chimney for heating an interior of the bucket thereby facilitating the bucket to keep a user warm when the user is near the bucket. A lid is attachable to the bucket for closing the bucket and a pair of cushions is each of the cushions is coupled to the lid and the cushions can be sat upon by the user. A pair of shoulder straps is each coupled to the bucket for carrying the bucket. A light emitter is coupled to the lid to emit light outwardly therefrom.

11 Claims, 8 Drawing Sheets

BUCKET HEATER ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to heater devices and more particularly pertains to a new heater device for keeping a user warm in a remote location. The device includes a bucket and a chimney that is integrated into the bucket. A heat source can is movably integrated into the chimney for containing a heat source which heats the chimney. The chimney subsequently heats an interior of the bucket thereby facilitating a user to warm themselves with the bucket. The device includes a lid which has cushions integrated into the lid to facilitate the user to sit on the cushions.

(2) Description of Related Art Including Information Disclosed Under 37 CFR 1.97 and 1.98

The prior art relates to heater devices including a variety of heater devices that each includes a can and a heat source that is positioned in the can for warming a user when the user sits on the can. The prior art discloses a portable stool that includes a plurality of fuel receptacles each integrated into the stool for holding a combustible material to heat the stool thereby warming a user that is sitting on the stool. The prior art discloses a heated bucket device that includes a heat source positioned inside a bucket and a vent pipe that is pivotally integrated into the bucket which can direct heat beneath a user's clothes when the user sits on the bucket. The prior art discloses a heated bucket device which includes a bucket that contains a combustible fuel and a lid that extends partially over the heated bucket such that the lid facilitates heat to pass out of the bucket.

BRIEF SUMMARY OF THE INVENTION

An embodiment of the disclosure meets the needs presented above by generally comprising a bucket that has a vent hole extending through the bucket. A chimney is integrated into the bucket and the chimney extends through the vent hole. A heat source can be positioned in the chimney for heating an interior of the bucket thereby facilitating the bucket to warm a user warm when the user is near the bucket. A lid is attachable to the bucket for closing the bucket and a pair of cushions is each of the cushions is coupled to the lid and the cushions can be sat upon by the user. A pair of shoulder straps is each coupled to the bucket for carrying the bucket. A light emitter is coupled to the lid to emit light outwardly therefrom.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
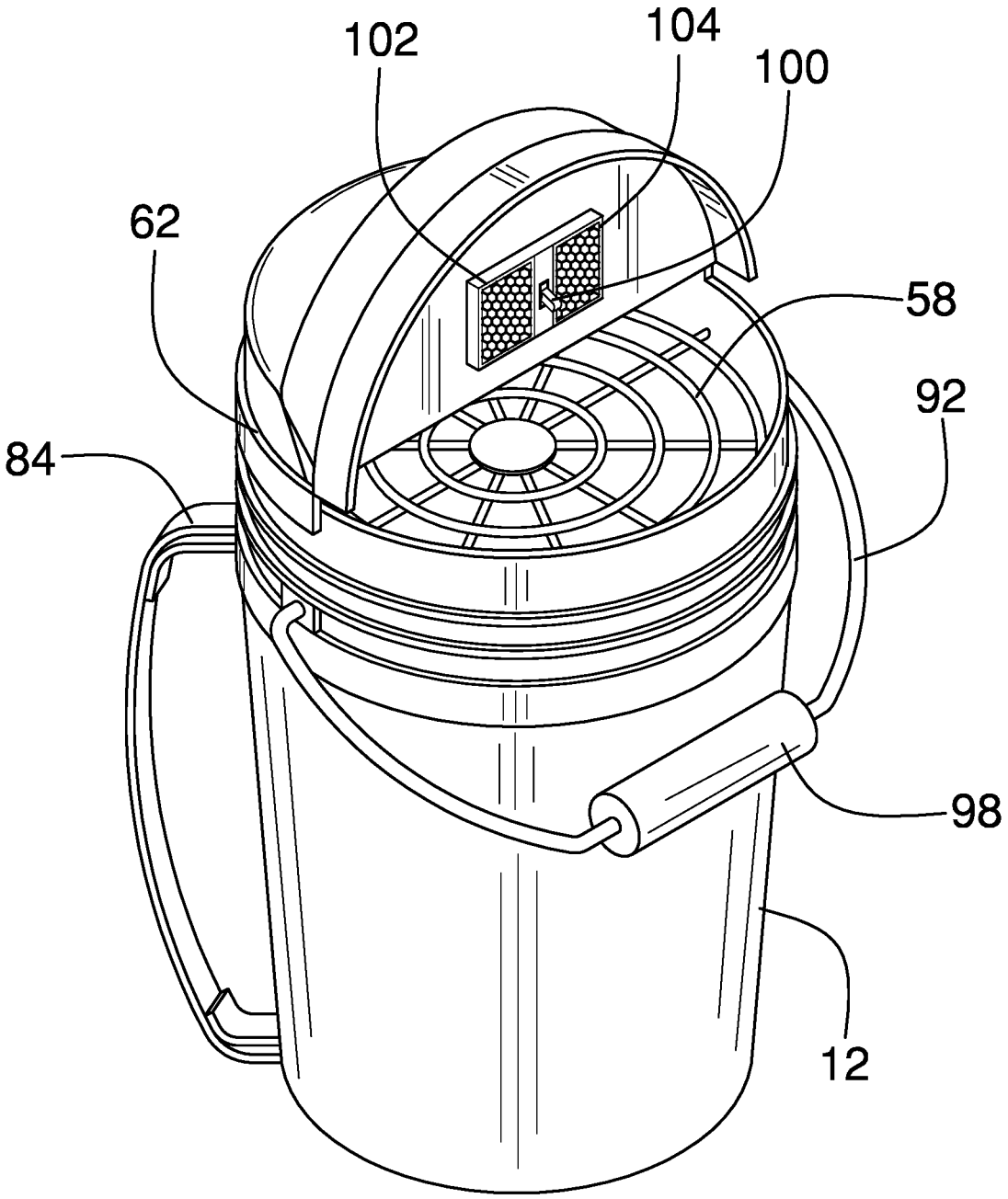
FIG. 1 is a top perspective view of a bucket heater assembly according to an embodiment of the disclosure.
Figure 2:
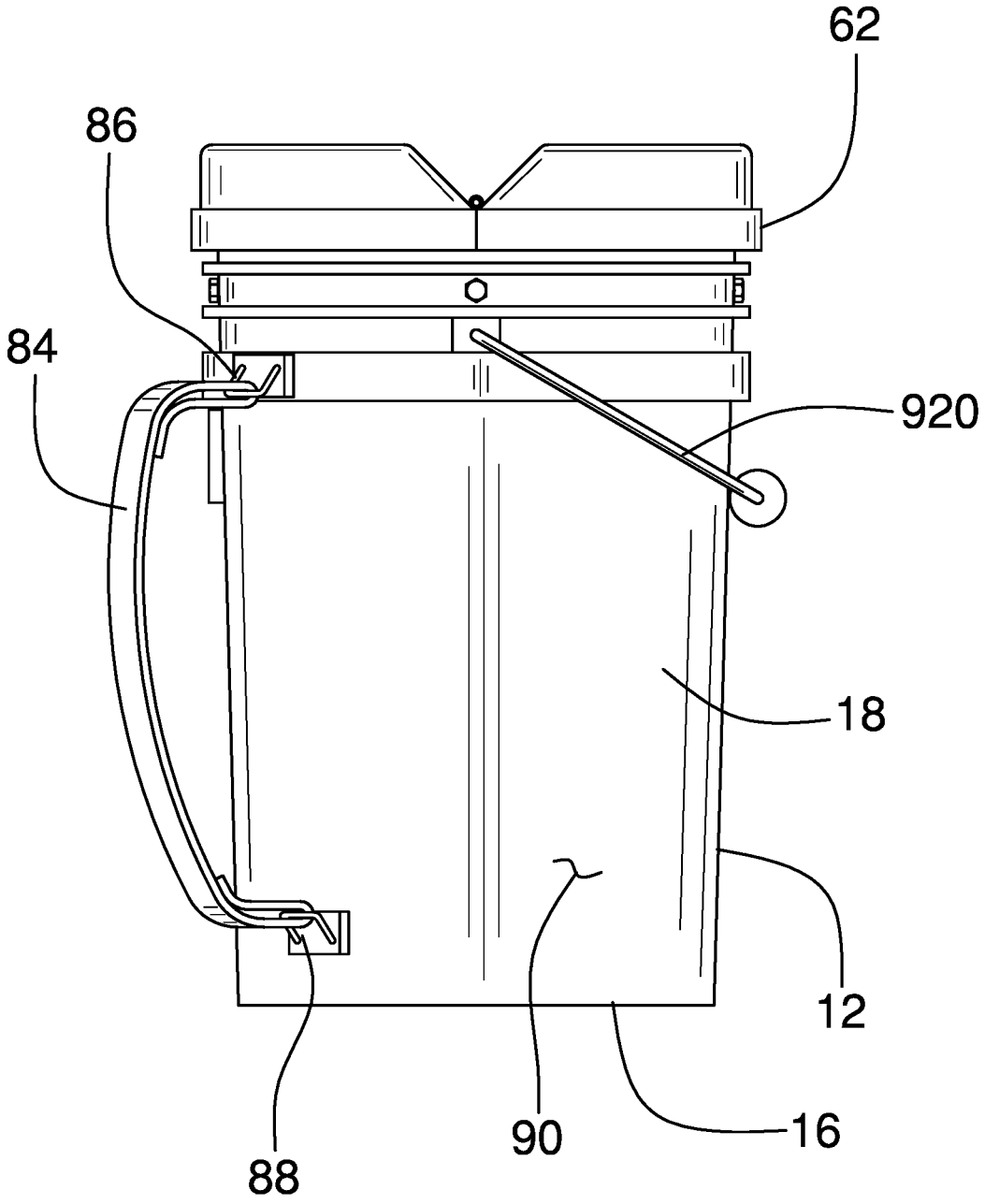
FIG. 2 is a left side view of an embodiment of the disclosure.
Figure 3:
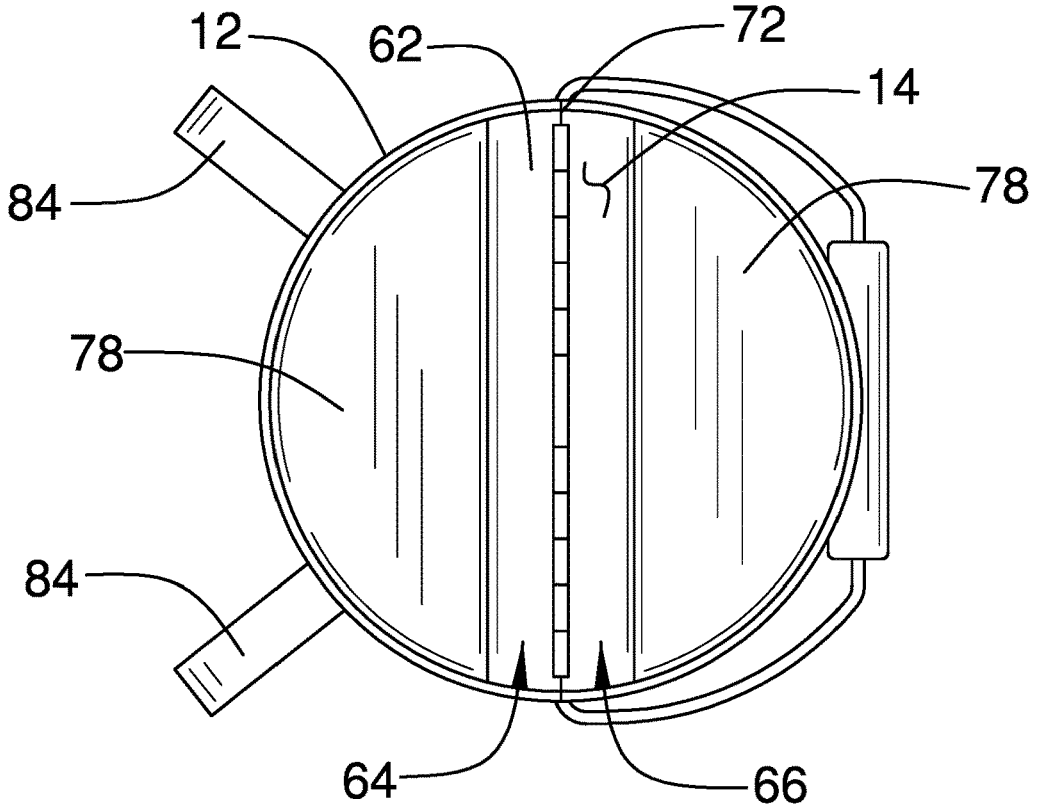
FIG. 3 is a top view of an embodiment of the disclosure.
Figure 4:
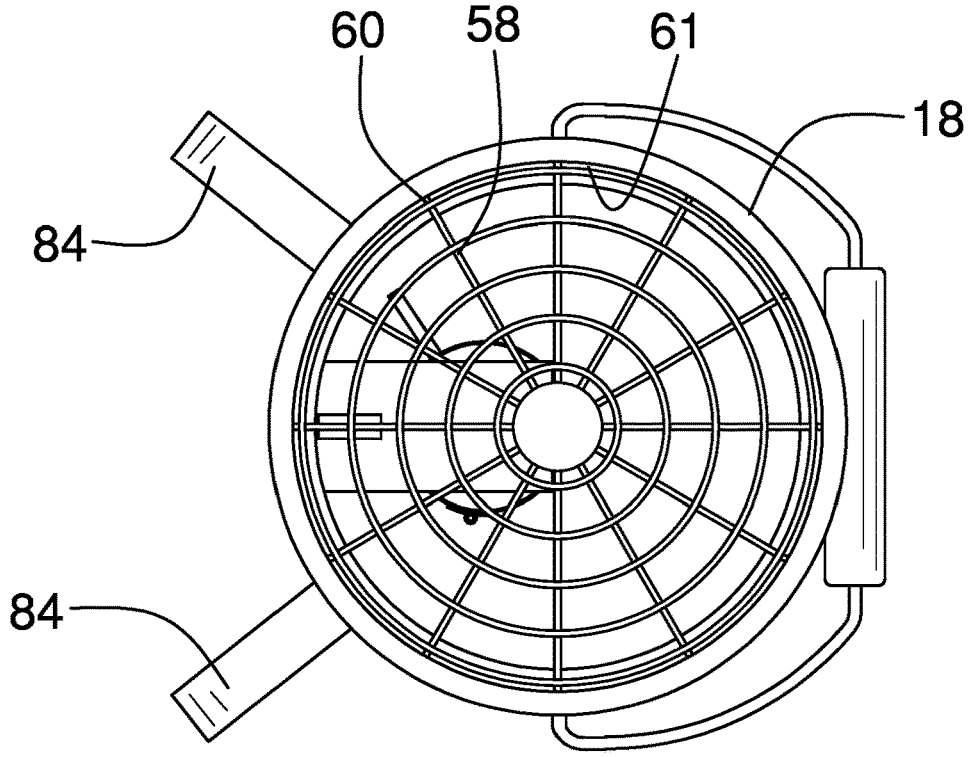
FIG. 4 is a top view of an embodiment of the disclosure showing a bucket with a lid removed from the bucket.
Figure 5:
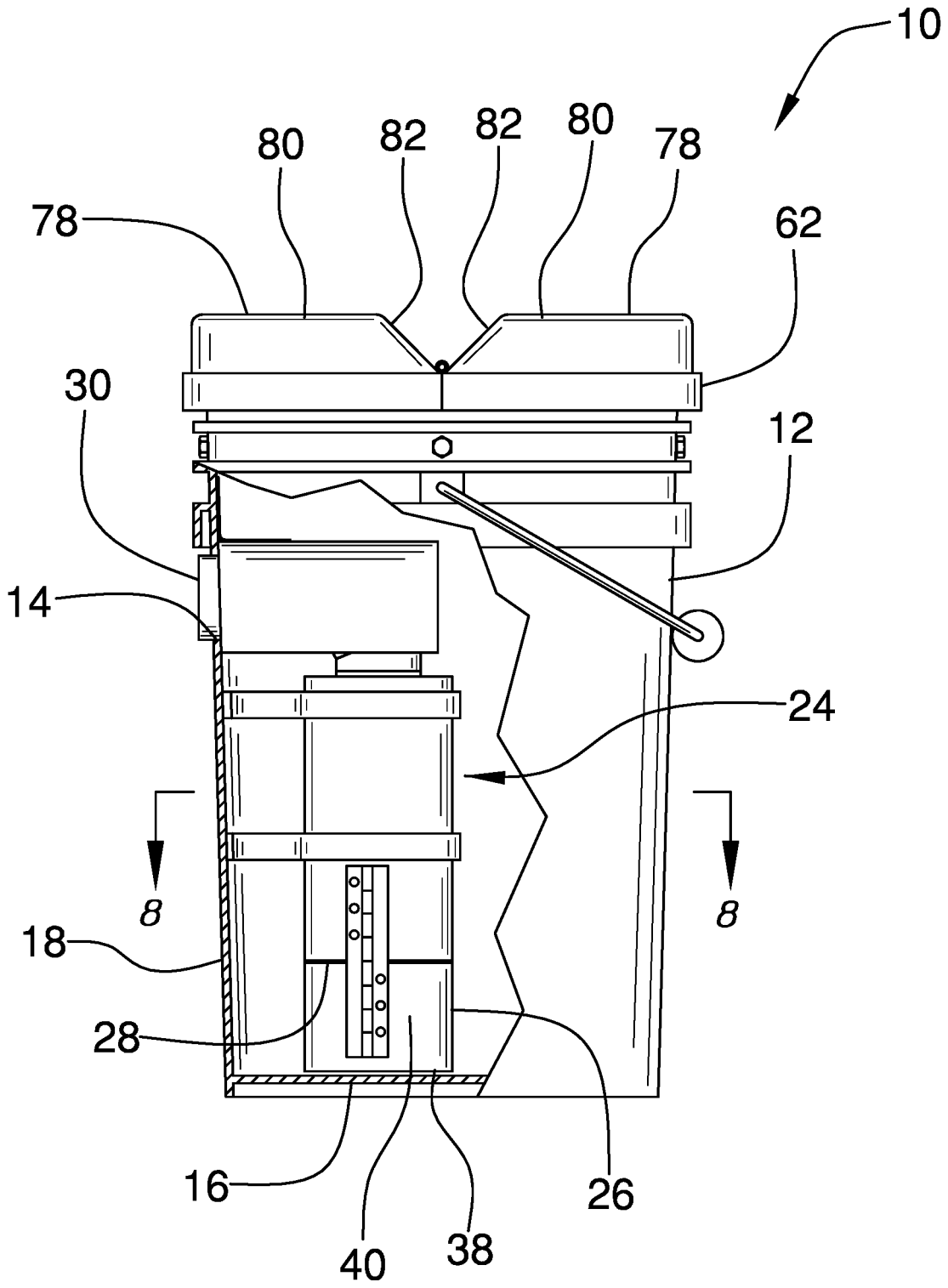
FIG. 5 is a left side cut-away view of an embodiment of the disclosure.
Figure 6:
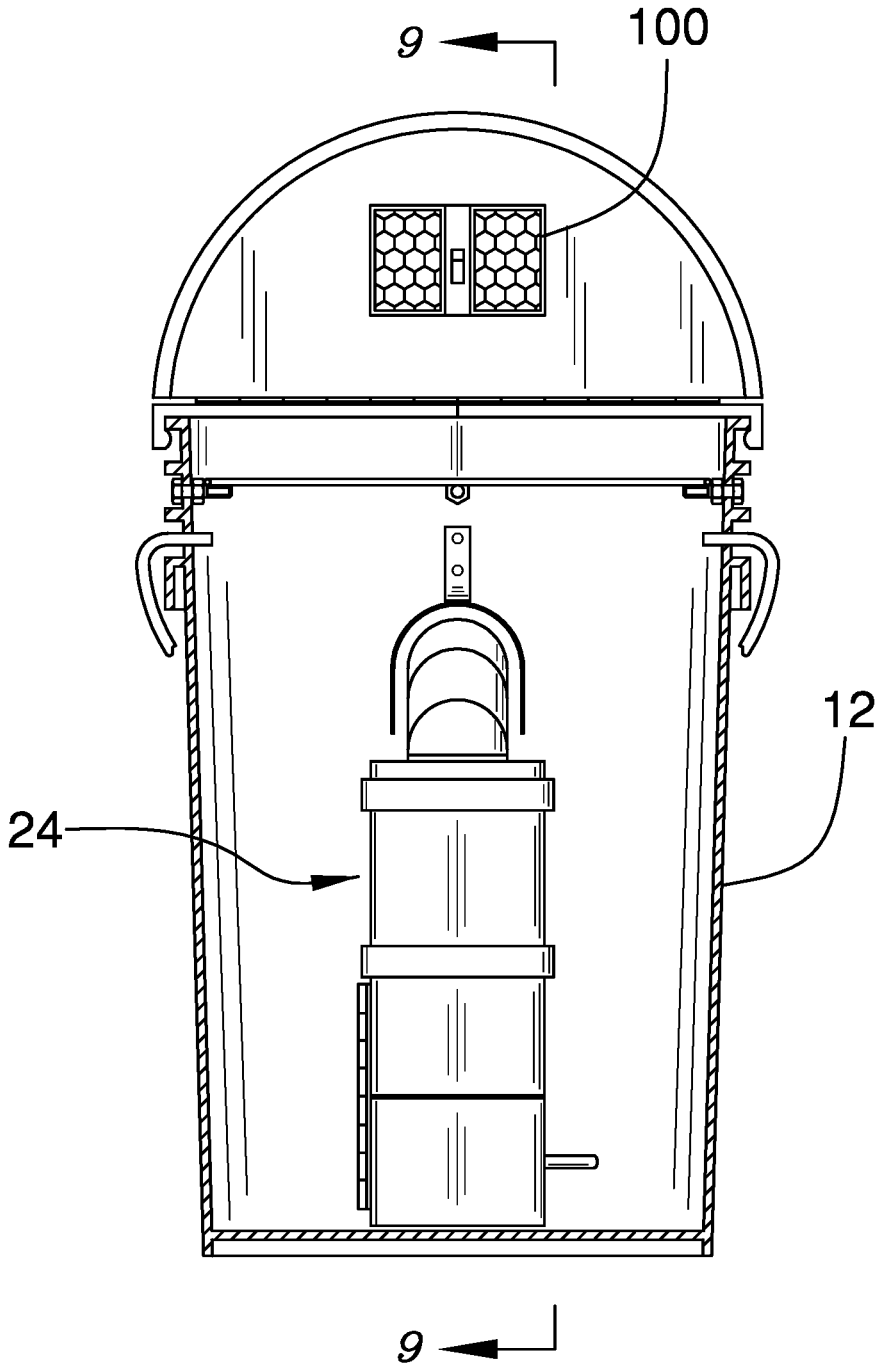
FIG. 6 is a front cut-away view of an embodiment of the disclosure.
Figure 7:
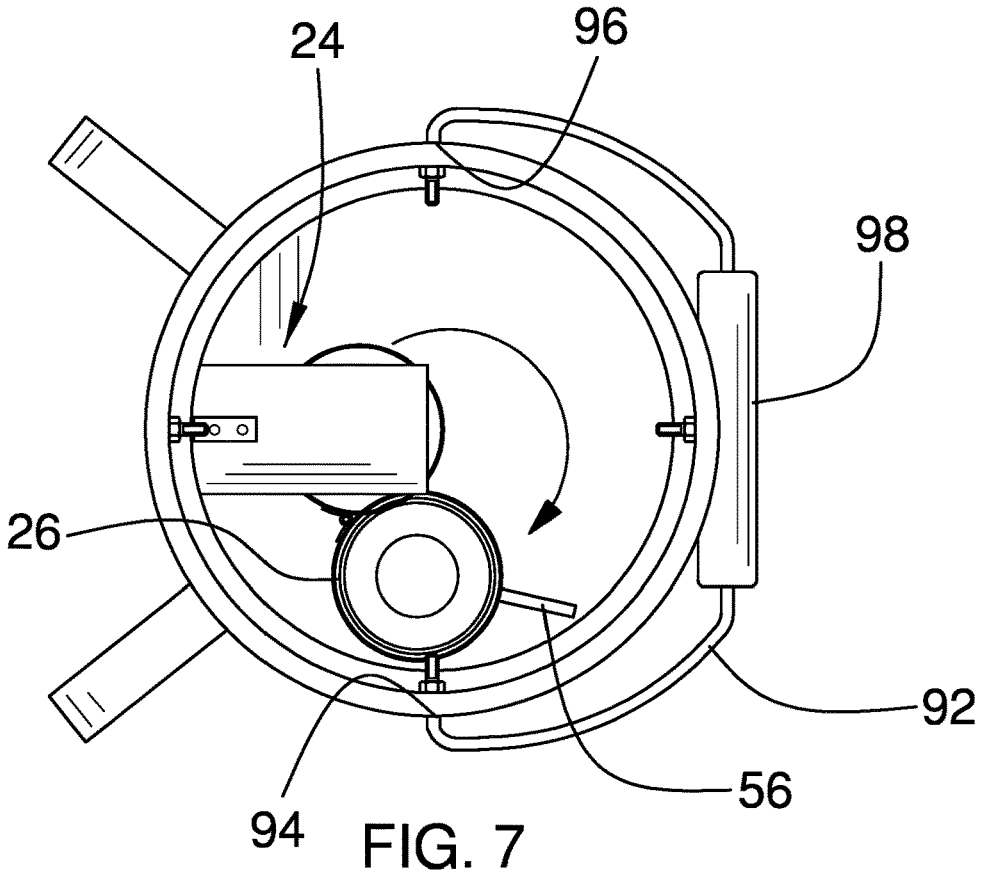
FIG. 7 is a top view of an embodiment of the disclosure showing a heat source can in an open position.
Figure 8:
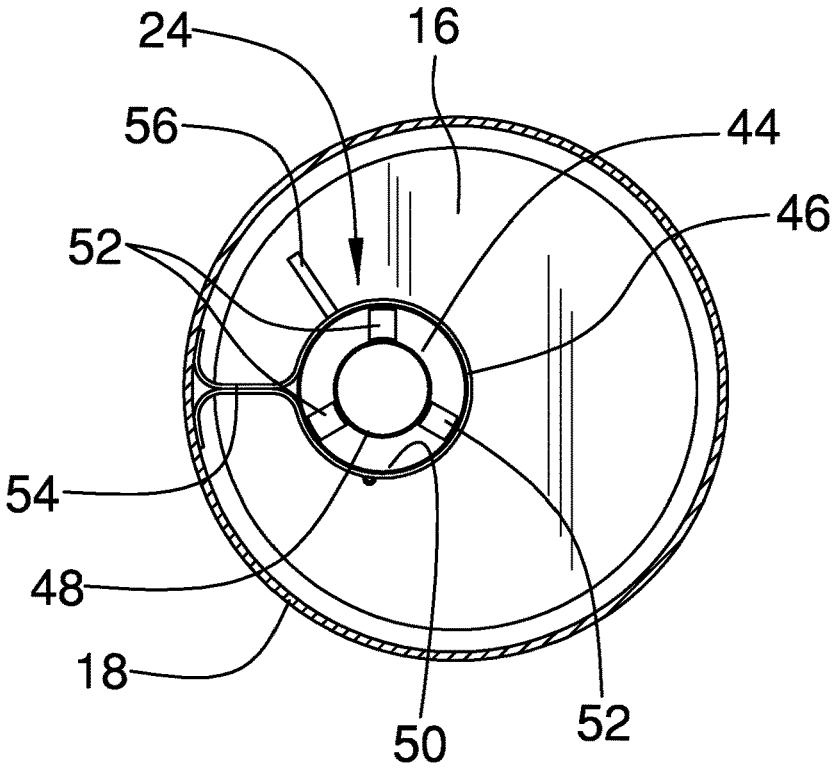
FIG. 8 is a cross sectional view taken along line 8-8 of FIG. 5 of an embodiment of the disclosure.
Figure 9:
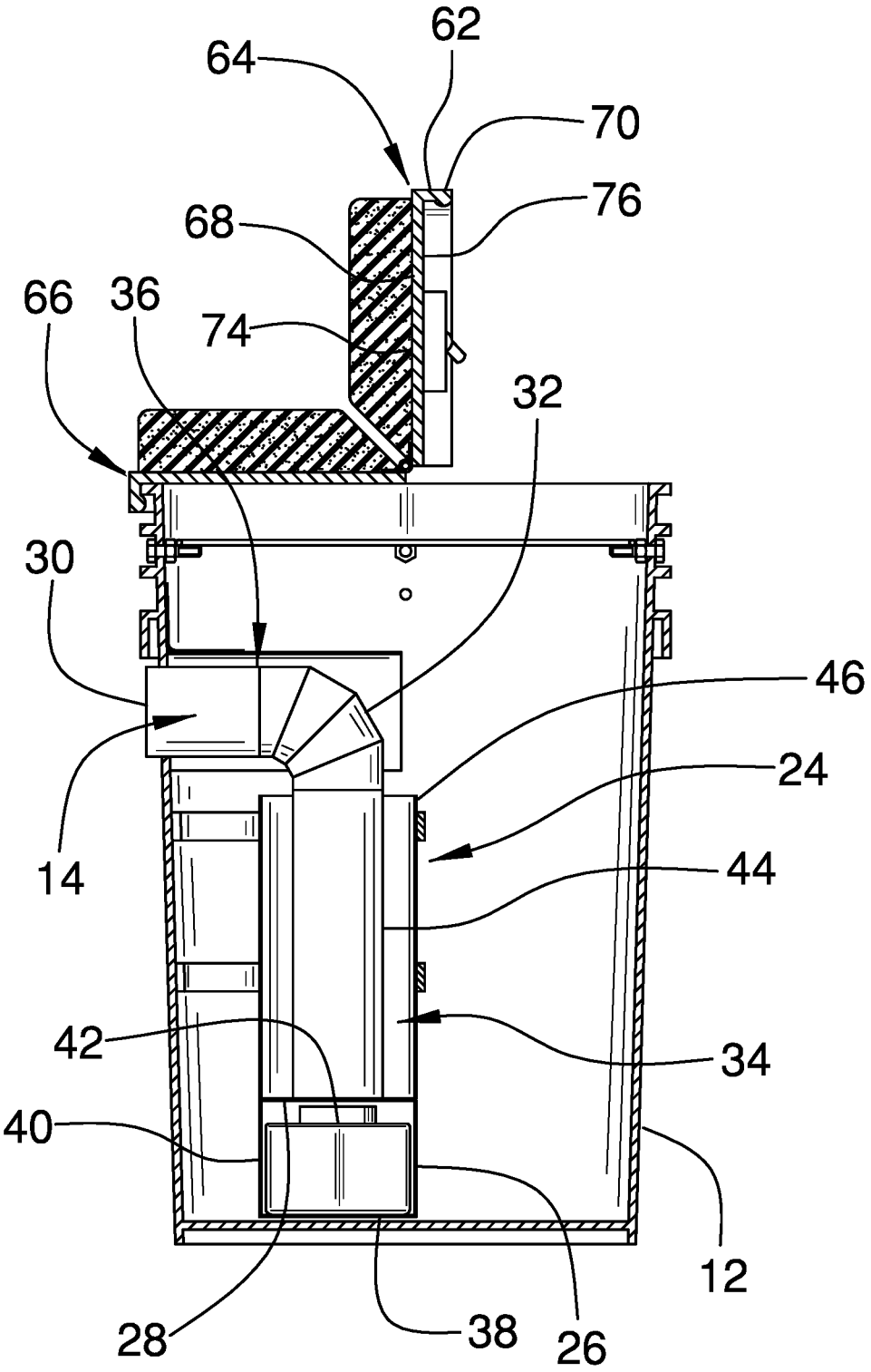
FIG. 9 is a cross sectional view taken along line 9-9 of FIG. 6 of an embodiment of the disclosure.
Figure 10:
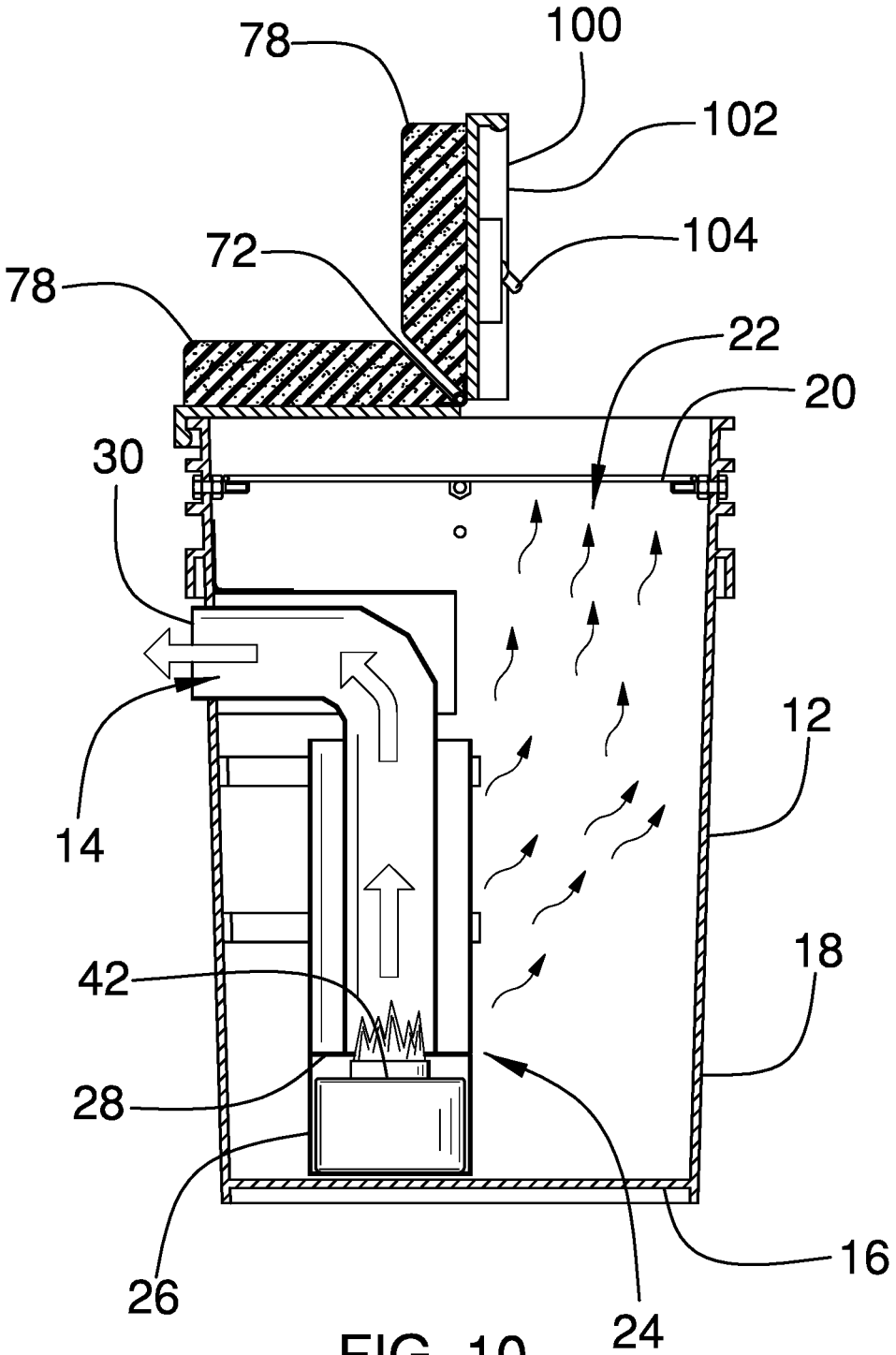
FIG. 10 is a cut-away in use view of an embodiment of the disclosure.

With reference now to the drawings, and in particular to FIGS. 1 through 10 thereof, a new heater device embodying the principles and concepts of an embodiment of the disclosure and generally designated by the reference numeral 10 will be described.

As best illustrated in FIGS. 1 through 10, the bucket heater assembly 10 generally comprises a bucket 12 that has a vent hole 14 extending through the bucket 12. The bucket 12 has a bottom wall 16 and an outer wall 18 extending upwardly from the bottom wall 16, and the outer wall 18 has a distal edge 20 with respect to the bottom wall 16 defining an opening 22 into the bucket 12. The vent hole 14 extends through the outer wall 18 into an interior of the bucket 12 and the vent hole 14 is positioned closer to the distal edge 20 than the bottom wall 16. The bucket 12 may be a five gallon bucket or other similar sized bucket 12.

A chimney 24 is integrated into the bucket 12 and the chimney 24 extends through the vent hole 14. The chimney 24 has a heat source can 26 and the heat source can 26 is positionable in an open position such that the heat source can 26 is displaced with the chimney 24. Conversely, the heat source can 26 is positionable in a closed position such that the heat source can 26 is aligned with the chimney 24. The chimney 24 has a lower end 28 and an upper end 30, and the chimney 24 has a bend 32 therein defining a lower portion 34 of the chimney 24 forming an angle with an upper portion 36 of the chimney 24. The lower end 28 is associated with the lower portion 34 and the upper end 30 is associated with the upper portion 36. Furthermore, the lower portion 34 is vertically oriented in the bucket 12 having the upper portion 36 extending outwardly through the vent hole 14 in the outer wall 18 of the bucket 12.

The heat source can 26 is hingedly integrated into the lower portion 34, and the heat source can 26 has a basal wall 38 and an outside wall 40 extending upwardly from the basal wall 38. The outside wall 40 is hingedly coupled to the lower portion 34 of the chimney 24 and the outside wall 40 is aligned with the lower end 28 when the heat source can 26 is in the closed position. A heat source 42 can be positioned in the heat source can 26 and the heat source 42 might be a sterno can or other type of pre-packaged combustible heat source. Additionally, the chimney 24 may be constructed of steel or other similar type of material.

The chimney 24 has an inner portion 44 and an outer portion 46 surrounding the inner portion 44. Each of the inner portion 44 and the outer portion 46 is comprised of a thermally conductive material such that the inner portion 44 is heated by the heat source 42 positioned in the heat source can 26. Furthermore, the outer portion 46 is in thermal communication with the inner portion 44 such that the outer portion 46 is heated by the heat source 42 positioned in the heat source can 26. The outer portion 46 is in thermal communication with the interior of the bucket 12 to heat the interior of the bucket 12. In this way the chimney 24 helps keep a user warm when the user is near the bucket 12.

The inner portion 44 has an outside surface 48 and the outer portion 46 has an inside surface 50. The chimney 24 has a plurality of interior supports 52 each extending between the outside surface 48 of the inner portion 44 and the inside surface 50 of the outer portion 46 thereby spacing the outer portion 46 from the inner portion 44. Additionally, the chimney 24 has a plurality of outer supports 54 each extending between the outer portion 46 and the outer wall 18 of the bucket 12 for securing the chimney 24 to the outer wall 18 of the bucket 12. The heat source can 26 has a handle 56 extending away from the outside wall 40 of the heat source can 26. The handle 56 can be gripped for moving the heat source can 26 between the open position and the closed position.

A grill 58 is integrated into the bucket 12 and the grill 58 has an outer edge 60 which is integrated into an inside surface 61 of the outer wall 18 of the bucket 12. The grill 58 is positioned adjacent to the distal edge 20 of the outer wall 18 and the grill 58 is oriented to extend across the opening 22 defined by the distal edge 20 of the outer wall 18. A lid 62 is attachable to the bucket 12 for closing the bucket 12. The lid 62 includes a first half 64 that is hingedly coupled to a second half 66. Either of the first half 64 or the second half 66 is positionable in an open position when the lid 62 is attached to the bucket 12 for accessing the interior of the bucket 12. The lid 62 has a top wall 68 and a perimeter wall 70 extending downwardly from the top wall 68. Additionally, the lid 62 has a cut 72 extending through the top wall 68 and the perimeter wall 70 to define the first half 64 and the second half 66. The cut 72 bisects the lid 62 and the top wall 68 has an upper surface 74 and a lower surface 76.

A pair of cushions 78 is provided and each of the cushions 78 is coupled to the lid 62 such that each of the cushions 78 can be sat upon by the user. Each of the cushions 78 is positioned on a respective one of the first half 64 and the second half 66 of the lid 62, and each of the cushions 78 is positioned on the upper surface 74 of the top wall 68. Each of the cushions 78 has an upper side 80 and a front side 82 extending between the upper side 80 and the upper surface 74 of the top wall 68. Furthermore, the front side 82 of each of the cushions 78 slopes between the upper surface 74 and the upper surface 74 of the top wall 68. The front side 82 of each of the cushions 78 is aligned with the cut 72 and the front side 82 of each of the cushions 78 slopes away from each other. In this way the cushions 78 are inhibited from abutting each other when either of the first half 64 or the second half 66 is positioned in the open position.

A pair of shoulder straps 84 is provided and each of the shoulder straps 84 is coupled to the bucket 12. Each of the shoulder straps 84 can be worn over the user's shoulders for carrying the bucket 12. Each of the shoulder straps 84 has a first end 86 and a second end 88, and each of the first end 86 and the second end 88 of each of the shoulder straps 84 is coupled to an outside surface 90 of the outer wall 18. Additionally, each of the shoulder straps 84 is oriented to extend substantially between the bottom wall 16 of the bucket 12 and the distal edge 20 of the outer wall 18.

A handle 92 is pivotally coupled to the bucket 12 for carrying the bucket 12. The handle 92 has a primary end 94 and a secondary end 96, and the handle 92 is curved between the primary end 94 and the secondary end 96. Each of the primary end 94 and the secondary end 96 is pivotally coupled to the outside surface 90 of the outer wall 18 of the bucket 12 at a point that is located adjacent to the distal edge 20 of the outer wall 18. A pad 98 may be positioned around the handle 92 to enhance comfort when the handle 92 is gripped. The pad 98 may be centrally positioned between said primary end 94 and the secondary end 96 of the handle 92.

A light emitter 100 is coupled to the lid 62 to emit light outwardly from the lid 62. The light emitter 100 is positioned on the lower surface 76 of the top wall 68 of the lid 62. Additionally, the light emitter 100 is positioned on the first half 64 of the lid 62 such that the light emitter 100 can illuminate the environment around the bucket 12 when the first half 64 is opened. The light emitter 100 may include a housing 102 and a power switch 104 that is movably integrated into the housing 102.

In use, the heat source can 26 is positioned in the open position to facilitate the heat source 42 to be positioned in the heat source can 26. The heat source 42 is ignited and the heat source can 26 is positioned in the closed position. In this way the heat source 42 heats the chimney 24 thereby facilitating the chimney 24 to heat the interior of the bucket 12. Thus, the bucket 12 keeps the user warm when the user is near the bucket 12. In this way the user can stay warm while the user is hunting, fishing or during any other outdoor activity. The user can warm their hands while ice fishing, for example, and the bucket can inhibit ice from forming on the line of a fishing rod while ice fishing. Additionally, the shoulder straps 84 can be worn over the user's shoulders for carrying the bucket 12. Objects can be contained in the bucket 12 to transport the objects while the bucket 12 is being carried.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A bucket heater assembly for keeping a user warm in a remote location, said assembly comprising:

a bucket having a vent hole extending through said bucket;

a chimney being integrated into said bucket, said chimney extending through said vent hole, said chimney having a heat source can wherein said heat source can is configured to have a heat source positioned in said heat source can for heating said chimney thereby facilitating said bucket to warm a user, said heat source can being positionable in an open position such that said heat source can is displaced with said chimney, said heat source can being positionable in a closed position such that said heat source can is aligned with said chimney;

a lid being attachable to said bucket for closing said bucket, said lid including a first half being hingedly coupled to a second half, either of said first half or said second half being positionable in an open position when said lid is attached to said bucket for accessing said interior of said bucket;

a pair of cushions, each of said cushions being coupled to said lid wherein each of said cushions is configured to be sat upon by the user, each of said cushions being positioned on a respective one of said first half and said second half of said lid;

a pair of shoulder straps, each of said shoulder straps being coupled to said bucket wherein each of said shoulder straps is configured to be worn over the user's shoulder for carrying said bucket; and a light emitter being coupled to said lid wherein said light emitter is configured to emit light outwardly therefrom.

2. The assembly according to claim 1, wherein said bucket has a bottom wall and an outer wall extending upwardly from said bottom wall, said outer wall having a distal edge with respect to said bottom wall defining an opening into said bucket, said vent hole extending through said outer wall into an interior of said bucket, said vent hole being positioned closer to said distal edge than said bottom wall.

3. The assembly according to claim 2, wherein said chimney has a lower end and an upper end, said chimney having a bend therein defining a lower portion of said chimney forming an angle with an upper portion of said chimney, said lower end being associated with said lower portion, said upper end being associated with said upper portion, said lower portion being vertically oriented in said bucket having said upper portion extending outwardly through said vent hole in said outer wall of said bucket.

4. The assembly according to claim 3, wherein said heat source can is hingedly integrated into said lower portion, said heat source can having a basal wall and an outside wall extending upwardly from said basal wall, said outside wall being hingedly coupled to said lower portion of said chimney, said outside wall being aligned with said lower end when said heat source can is in said closed position.

5. The assembly according to claim 3, wherein said chimney has an inner portion and an outer portion surrounding said inner portion, each of said inner portion and said outer portion being comprised of a thermally conductive material wherein said inner portion is configured to be heated by a heat source positioned in said heat source can, said outer portion being in thermal communication with said inner portion wherein said outer portion is configured to be heated by the heat source positioned in said heat source can, said outer portion being in thermal communication with said interior of said bucket wherein said outer portion is configured to heat said interior of said bucket wherein said chimney is configured to keep a user warm when the user sits on said bucket.

6. The assembly according to claim 5, wherein:

said inner portion has an outside surface, said outer portion having an inside surface, said chimney having a plurality of interior supports each extending between said outside surface of said inner portion and said inside surface of said outer portion thereby spacing said outer portion from said inner portion; and said chimney has a plurality of outer supports each extending between said outer portion and said outer wall of said bucket for securing said chimney to said outer wall of said bucket; said heat source can having a handle extending away from said outside wall of said heat source can wherein said handle is configured to be gripped for moving said heat source can between said open position and said closed position.

7. The assembly according to claim 2, further comprising a grill being integrated into said bucket, said grill having an outer edge being integrated into an inside surface of said outer wall of said bucket, said grill being positioned adjacent to said distal edge of said outer wall, said grill being oriented to extend across said opening defined by said distal edge of said outer wall.

8. The assembly according to claim 1, wherein:

said lid has a top wall and a perimeter wall extending downwardly from said top wall, said lid having a cut extending through said top wall and said perimeter wall to define said first half and said second half, said cut bisecting said lid, said top wall having an upper surface and a lower surface;

each of said cushions is positioned on said upper surface of said top wall, each of said cushions having an upper side and a front side extending between said upper side and said upper surface of said top wall, said front side of each of said cushions sloping between said upper surface and said upper surface of said top wall, said front side of each of said cushions being aligned with said cut, said front side of each of said cushions sloping away from each other to inhibit either of said cushions from abutting each other when either of said first half or said second half is positioned in said open position.

9. The assembly according to claim 2, wherein each of said shoulder straps has a first end and a second end, each of said first end and said second end of each of said shoulder straps being coupled to an outside surface of said outer wall of said bucket, each of said shoulder straps being oriented to extend substantially between said bottom wall of said bucket and said distal edge of said outer wall of said bucket.

10. The assembly according to claim 2, wherein said light emitter is positioned on said lower surface of said top wall of said lid, said light emitter being positioned on said first half of said lid wherein said light emitter is configured to illuminate the environment around said bucket when said first half is opened.

11. A bucket heater assembly for keeping a user warm in a remote location, said assembly comprising:

a bucket having a vent hole extending through said bucket, said bucket having a bottom wall and an outer wall extending upwardly from said bottom wall, said outer wall having a distal edge with respect to said bottom wall defining an opening into said bucket, said vent hole extending through said outer wall into an interior of said bucket, said vent hole being positioned closer to said distal edge than said bottom wall;

a chimney being integrated into said bucket, said chimney extending through said vent hole, said chimney having a heat source can, said heat source can being positionable in an open position such that said heat source can is displaced with said chimney, said heat source can being positionable in a closed position such that said heat source can is aligned with said chimney, said chimney having a lower end and an upper end, said chimney having a bend therein defining a lower portion of said chimney forming an angle with an upper portion of said chimney, said lower end being associated with said lower portion, said upper end being associated with said upper portion, said lower portion being vertically oriented in said bucket having said upper portion extending outwardly through said vent hole in said outer wall of said bucket, said heat source can being hingedly integrated into said lower portion, said heat source can having a basal wall and an outside wall extending upwardly from said basal wall, said outside wall being hingedly coupled to said lower portion of said chimney, said outside wall being aligned with said lower end when said heat source can is in said closed position, said chimney having an inner portion and an outer portion surrounding said inner portion, each of said inner portion and said outer portion being comprised of a thermally conductive material wherein said inner portion is configured to be heated by a heat source positioned in said heat source can, said outer portion being in thermal communication with said inner portion wherein said outer portion is configured to be heated by the heat source positioned in said heat source can, said outer portion being in thermal communication with said interior of said bucket wherein said outer portion is configured to heat said interior of said bucket wherein said chimney is configured to keep a user warm when the user is near said bucket, said inner portion having an outside surface, said outer portion having an inside surface, said chimney having a plurality of interior supports each extending between said outside surface of said inner portion and said inside surface of said outer portion thereby spacing said outer portion from said inner portion, said chimney having a plurality of outer supports each extending between said outer portion and said outer wall of said bucket for securing said chimney to said outer wall of said bucket; said heat source can having a handle extending away from said outside wall of said heat source can wherein said handle is configured to be gripped for moving said heat source can between said open position and said closed position;

a grill being integrated into said bucket, said grill having an outer edge being integrated into an inside surface of said outer wall of said bucket, said grill being positioned adjacent to said distal edge of said outer wall, said grill being oriented to extend across said opening defined by said distal edge of said outer wall;

a lid being attachable to said bucket for closing said bucket, said lid including a first half being hingedly coupled to a second half, either of said first half or said second half being positionable in an open position when said lid is attached to said bucket for accessing said interior of said bucket, said lid having a top wall and a perimeter wall extending downwardly from said top wall, said lid having a cut extending through said top wall and said perimeter wall to define said first half and said second half, said cut bisecting said lid, said top wall having an upper surface and a lower surface;

a pair of cushions, each of said cushions being coupled to said lid wherein each of said cushions is configured to be sat upon by the user, each of said cushions being positioned on a respective one of said first half and said second half of said lid, each of said cushions being positioned on said upper surface of said top wall, each of said cushions having an upper side and a front side extending between said upper side and said upper surface of said top wall, said front side of each of said cushions sloping between said upper surface and said upper surface of said top wall, said front side of each of said cushions being aligned with said cut, said front side of each of said cushions sloping away from each other to inhibit either of said cushions from abutting each other when either of said first half or said second half is positioned in said open position;

a pair of shoulder straps, each of said shoulder straps being coupled to said bucket wherein each of said shoulder straps is configured to be worn over the user's shoulder for carrying said bucket, each of said shoulder straps having a first end and a second end, each of said first end and said second end of each of said shoulder straps being coupled to an outside surface of said outer wall, each of said shoulder straps being oriented to extend substantially between said bottom wall of said bucket and said distal edge of said outer wall;

a handle being pivotally coupled to said bucket for carrying said bucket, said handle having a primary end and a secondary end, said handle being curved between said primary end and said secondary end, each of said primary end and said secondary end being pivotally coupled to said outside surface of said outer wall of said bucket at a point being located adjacent to said distal edge of said outer wall; and a light emitter being coupled to said lid wherein said light emitter is configured to emit light outwardly therefrom, said light emitter being positioned on said lower surface of said top wall of said lid, said light emitter being positioned on said first half of said lid wherein said light emitter is configured to illuminate the environment around said bucket when said first half is opened.

* * * * *